US007309206B2

(12) United States Patent
Oi

(10) Patent No.: US 7,309,206 B2
(45) Date of Patent: Dec. 18, 2007

(54) FUEL PUMP RECEIVED IN HOUSING

(75) Inventor: Kiyotoshi Oi, Anjo (JP)

(73) Assignee: Denso Corporation (JP)

( * ) Notice: Subject to any disclaimer, the term of this patent is extended or adjusted under 35 U.S.C. 154(b) by 343 days.

(21) Appl. No.: 11/038,442

(22) Filed: Jan. 21, 2005

(65) Prior Publication Data

US 2005/0163605 A1 Jul. 28, 2005

(30) Foreign Application Priority Data

Jan. 22, 2004 (JP) ..... 2004-014784

(51) Int. Cl.
*F01D 1/12* (2006.01)

(52) U.S. Cl. ..... 415/55.1

(58) Field of Classification Search ..... 415/55.1, 415/55.5, 213.1

See application file for complete search history.

(56) References Cited

U.S. PATENT DOCUMENTS 3,881,839 A * 5/1975 MacManus ..... 415/55.4
4,958,984 A * 9/1990 Aoi et al. ..... 415/55.1
5,174,713 A * 12/1992 Iwai et al. ..... 415/55.1
5,551,842 A * 9/1996 Schmid et al. ..... 417/203

FOREIGN PATENT DOCUMENTS

JP A-59-150995 8/1984
JP B2-2-39638 9/1990

OTHER PUBLICATIONS

Chinese Examination Report issued Apr. 10, 2007 in corresponding Chinese Application No. 200510004642.X, together with an English translation.

* cited by examiner

*Primary Examiner*—Edward K. Look
*Assistant Examiner*—Devin Hanan
(74) *Attorney, Agent, or Firm*—Nixon & Vanderhye PC

(57) ABSTRACT

A fuel pump includes a rotor, a rotating member, a pump portion, and a housing. The rotating member is rotated by the rotor to generate suction force for drawing fuel. The pump portion includes a pump casing that receives the rotating member. The housing receives the rotor and the pump portion. The housing has an inner circumferential periphery. The pump casing has an outer circumferential periphery. At least one of the inner circumferential periphery of the housing and the outer circumferential periphery of the pump casing has a plurality of protrusions that protrudes in a substantially radial direction. The plurality of protrusions is arranged in a circumferential direction. The plurality of protrusions is press-inserted into at least one of the inner circumferential periphery of the housing and the outer circumferential periphery of the pump casing.

13 Claims, 4 Drawing Sheets

FUEL PUMP RECEIVED IN HOUSING

CROSS REFERENCE TO RELATED APPLICATIONS

This application is based on and incorporates herein by reference Japanese Patent Application No. 2004-14784 filed on Jan. 22, 2004.

FIELD OF THE INVENTION

The present invention relates to a fuel feed pump.

BACKGROUND OF THE INVENTION

A fuel feed pump disclosed in JP-B2-H2-39638 includes a pump casing that receives a rotating member to pump fuel received in a fuel tank. The pump casing is press-inserted into a housing. When the outer circumferential periphery of the pump casing is entirely press-inserted into the housing, the pump casing receives radial force from the entire outer circumferential periphery, and the pump casing may be deformed. As a result, an internal clearance, which is formed between the pump casing and the rotating member, may decrease. In this case, when the rotating member contacts with the pump casing, rotation of the rotating member may be disturbed, and a pumping capacity of the fuel pump may decrease.

In view of the foregoing problems, it is an object of the present invention to produce a fuel feed pump, in which deformation of a pump casing received in a housing is reduced to produce a predetermined pumping capacity.

According to the present invention, a fuel pump includes a rotor, a rotating member, a pump portion, and a housing. The rotating member is rotated by the rotor. The rotating member generates suction force for drawing fuel. The pump portion includes a pump casing that receives the rotating member. The housing receives the rotor and the pump portion. The housing has an inner circumferential periphery that contacts with an outer circumferential periphery of the pump casing in an axial direction of the rotor to form a sealing portion, in which the housing and the pump casing are sealed therebetween. The inner circumferential periphery of the housing and the outer circumferential periphery of the pump casing form a gap in the radial direction of the housing on one of the side of the rotor and the opposite side as the rotor with respect to the sealing portion.

Alternatively, a fuel pump includes a rotor, a rotating member, a pump portion, and a housing. The rotating member is rotated by the rotor. The rotating member generates suction force for drawing fuel. The pump portion includes a pump casing that receives the rotating member. The housing receives the rotor and the pump portion. The housing has an inner circumferential periphery. The pump casing has an outer circumferential periphery. At least one of the inner circumferential periphery of the housing and the outer circumferential periphery of the pump casing has multiple protrusions that protrude in a substantially radial direction of the housing. The protrusions are arranged in a substantially circumferential direction of the housing. The protrusions are press-inserted into at least one of the inner circumferential periphery of the housing and the outer circumferential periphery of the pump casing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
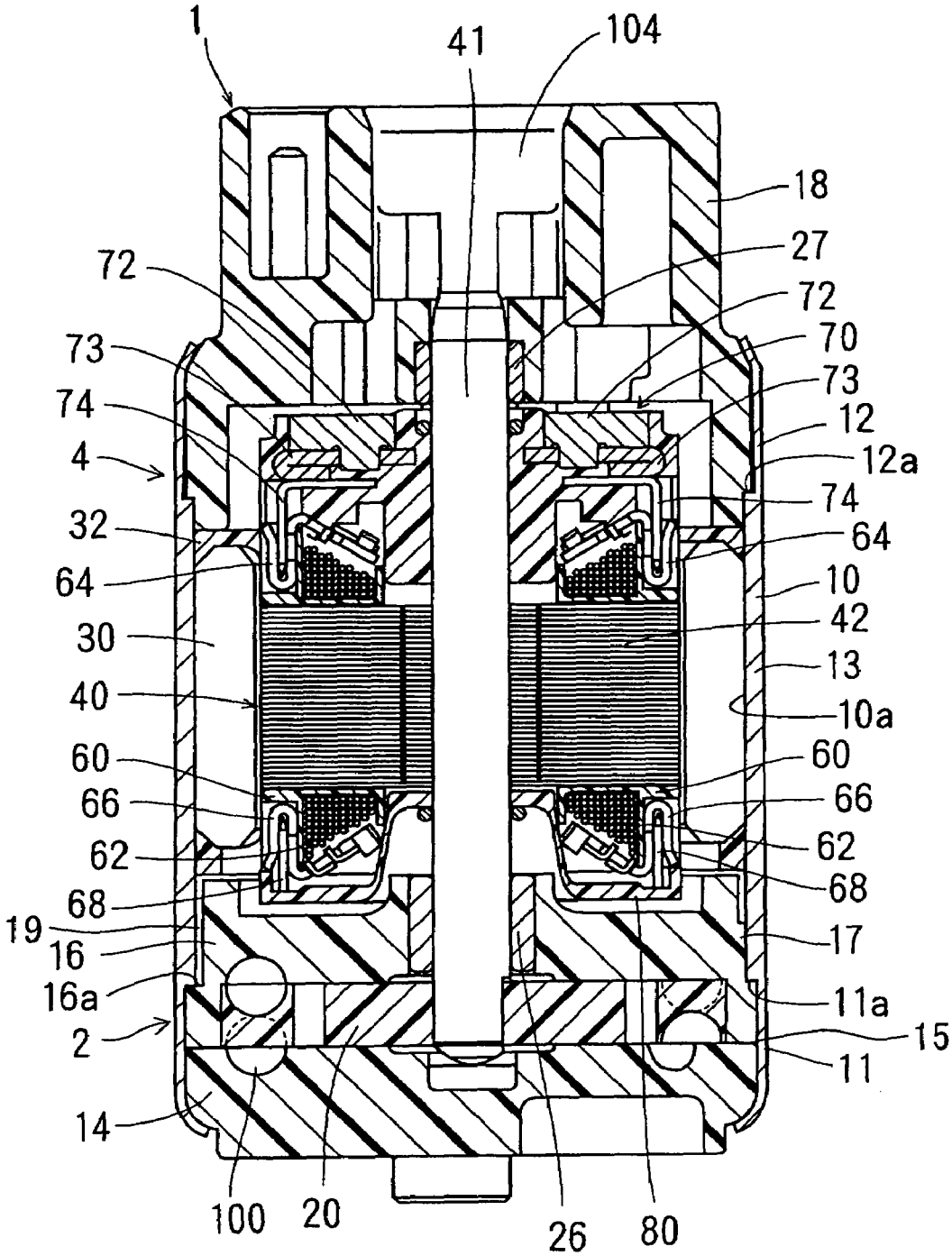
FIG. 1 is a partially cross-sectional side view showing a fuel feed pump according to a first embodiment of the present invention.

A fuel pump 1 shown in FIG. 1 is an in-tank type pump that is received in a fuel tank of a vehicle, for example. The fuel pump 1 pumps fuel received in a fuel tank to an engine that consumes fuel. The fuel pump 1 includes a pump portion 2 and a motor 4. The pump portion 2 pressurizes fuel drawn from the fuel tank. The motor 4 includes an armature 40 that rotates an impeller 20. The pump portion 2 includes an inlet cover 14 and an impeller casing 16. The impeller casing 16 receives the impeller 20. The inlet cover 14 and the impeller casing 16, which are formed of resin, serve as a pump casing. The motor 4 is a D.C. motor that includes permanent magnets 30, the armature 40, a commutator 70, and a cover 80. The armature 40, the commutator 70, and the cover 80 serve as a rotor. A housing 10 has thin wall portions 11, 12 on both axial ends, and has a thick wall portion 13 that is axially inserted between the thin wall portions 11, 12. The thin wall portion 11 is radially crimped, so that the inlet cover 14 is secured to the thin wall portion 11. The thin wall portion 12 is radially crimped, so that an outlet cover 18 is secured to the thin wall portions 12. Inner steps 11*a*,12*a* are respectively formed at boundaries among the thin wall portions 11, 12 and the thick wall portion 13, in which thickness of housing 10 stepwisely changes.

A pump passage 100 is formed in a C-shape between the inlet cover 14 and the impeller casing 16. The inlet cover 14 and the impeller casing 16 rotatably receive the impeller 20 that serves as a rotating member. The impeller casing 16 has a radially inner periphery that supports a bearing 26. The thin wall portion 11 of the housing 10 is radially crimped onto the inlet cover 14, so that the inner step 11*a* of the housing 10 entirely circumferentially contacts with an outer step 16*a* of the impeller casing 16. In this structure, the inner step 11*a* of the housing 10 is entirely circumferentially pressed onto the outer step 16*a* of the impeller casing 16 in the axial direction of the armature 40, so that the housing 10 and the impeller casing 16 are circumferentially tightly sealed therebetween by crimping force.

Figure 2:
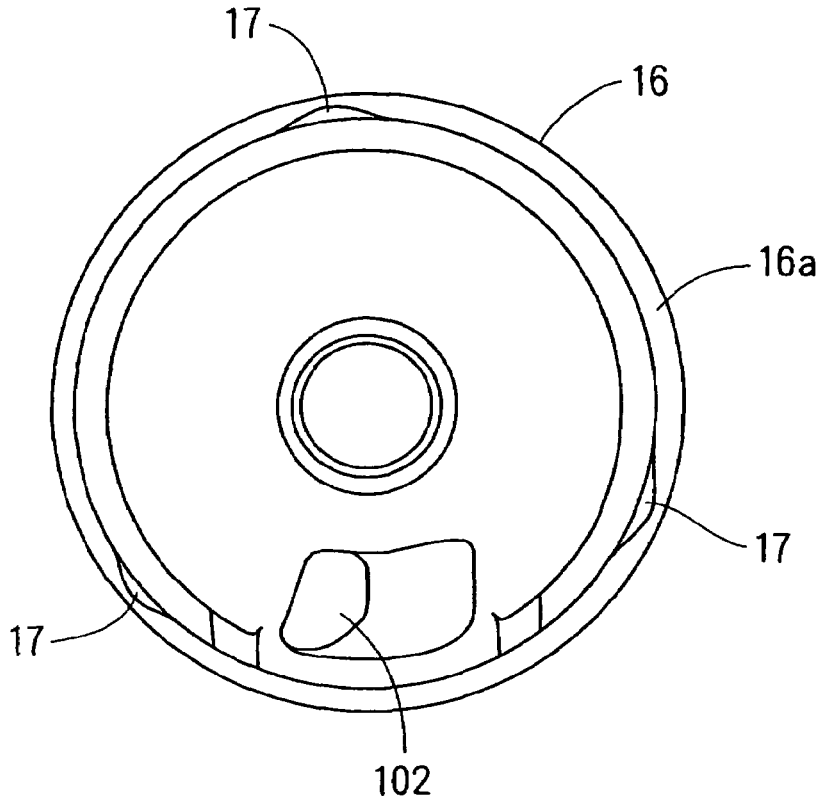
FIG. 2 is a top view showing an impeller casing of the fuel feed pump according to the first embodiment.

The impeller casing 16 has a substantially cylindrical shape, in which the outer diameter axially stepwisely changed. The outer diameter of the impeller casing 16 on the side of the armature 40 is smaller than the outer diameter of the impeller casing 16 on the axially opposite side as the armature 40. The outer circumferential periphery of the impeller casing 16 has an outer step 16*a*,in which the outer diameter is stepwisely changed. As shown in FIG. 2, the outer step 16*a* of the outer circumferential periphery of the impeller casing 16 has three protrusions 17 on the side of the armature 40. The three protrusions 17 are circumferentially arranged at substantially regular angular intervals. Each protrusion 17 substantially radially protrudes to an inner circumferential periphery 10*a* of the housing 10 that radially oppose to the protrusion 17. The three protrusions 17 are press-inserted into the inner circumferential periphery 10*a* of the housing 10, so that the center of the housing 10 and the center of the impeller casing 16 easily coincide with each other.

As shown in FIG. 1, the outer circumferential periphery of the impeller 20, which is formed in a circular plate shape, has multiple vane grooves. The impeller 20 serves as a rotating member that rotates in conjunction with a shaft 41 of the armature 40, so that pressure difference is generated between the frontward of each vane groove and the rearward of the vane groove due to fluid friction. Generation of pressure difference is repeated by the vane grooves, so that fluid is pressurized in the pump passage 100. The impeller 20 rotates, so that fuel received in the fuel tank is drawn into the pump passage 100 through a fuel inlet (not shown) formed in the inlet cover 14. The fuel flows from a communication port 102 (FIG. 2) of the impeller casing 16 to the side of the cover 80 that is located on one axial end side of the armature 40. Fuel flows to the side of the commutator 70 through the outer periphery of the armature 40, and the fuel passes through a fuel discharge port 104. Thus, the fuel is discharged from the fuel pump 1 to the side of the engine.

Each permanent magnet 30 is formed in a quarter-arc shape. Four of the permanent magnets 30 are circumferentially arranged on the inner circumferential periphery 10*a* of the housing 10. The four permanent magnets 30 form four magnetic poles that are opposite to each other in the rotating direction. The permanent magnets 30 are supported by a resinous member 32. The commutator 70 is assembled to the other axial end side of the armature 40. The cover 80 covers the axial end side of the armature 40 on the opposite side as the commutator 70. The shaft 41 is rotatably supported by the bearing 26, which is received in the impeller casing 16, and a bearing 27, which is received in the outlet cover 18, so that the shaft 41 serves as the rotation axis of the armature 40.

The armature 40 is divided into six poles of coil cores 42. A bobbin 60 and a coil 62 are provided to each coil core 42. Wire is wound around the bobbin 60 to form the coil 62. One end of the coil 62 electrically connects with each terminal 64, and the other end of the coil 62 electrically connects with each terminal 66. The three terminals 66, which are circumferentially adjacent to each other, are electrically connected with each other via a terminal 68.

The commutator 70 is integrally formed, and the commutator 70 has a cassette-type structure, in which six segments 72 are arranged in the rotating direction. Each segment 72 is formed of carbon. Segments 72, which are adjacent to each other in the rotating direction, are electrically insulated from each other. Each segment 72 electrically connects with a terminal 74 via an intermediate terminal 73. The terminal 74 electrically connects the segments 72 that radially oppose to each other. The commutator 70 is assembled to the armature 40, so that each terminal 74 of the commutator 70 engages with each terminal 64 of the armature 40, and the terminals 74, 64 are electrically connected with each other. The armature 40 rotates, so that each segment 72 of the commutator 70 sequentially contacts with a brush (not shown).

In this embodiment, the three protrusions 17 are provided to the outer circumferential periphery of the impeller casing 16 that is press-inserted into the inner circumferential periphery 10*a* of the housing 10. Therefore, the impeller casing 16, which receives the impeller 20 as a part of the pump casing, does not receive radial force entirely over the outer circumferential periphery. As a result, even when the impeller casing 16 is press-inserted into the housing 10, deformation of the impeller casing 16 can be reduced. Therefore, variation in clearance between the impeller 20 and the impeller casing 16 can be reduced, so that disturbance of rotation of the impeller 20 due to friction between the impeller casing 16 and the impeller 20 can be restricted. Thus, a predetermined pumping capacity of the fuel pump 1 can be produced.

Figure 3:
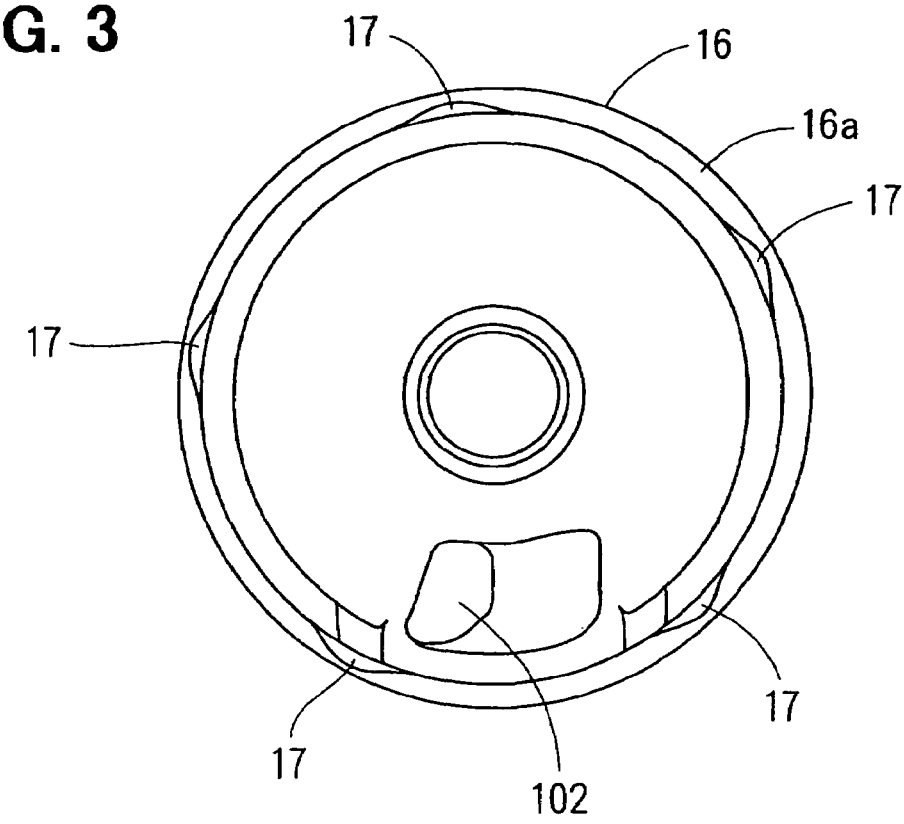
FIG. 3 is a top view showing a modified impeller casing according to the first embodiment.

As shown in FIG. 3, five of the protrusions 17 can be provided to the outer circumferential periphery of the impeller casing 16 at regular intervals.

Second Embodiment

Figure 4:
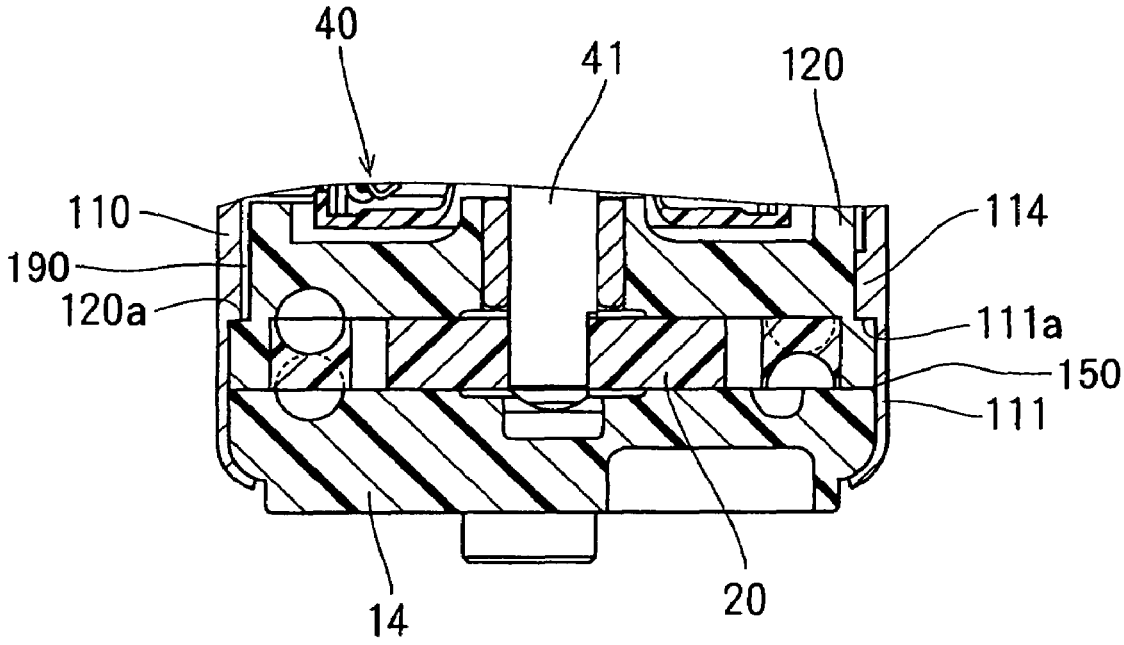
FIG. 4 is a partially cross-sectional side view showing an impeller of a fuel feed pump according to a second embodiment of the present invention.
Figure 5A:
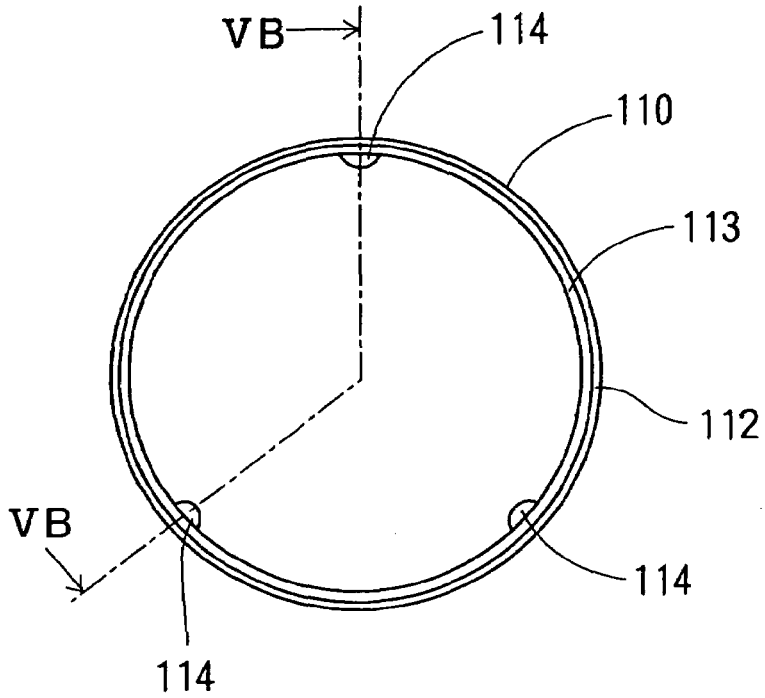
FIG. 5A is a top view showing a housing of the fuel feed pump.
Figure 5B:
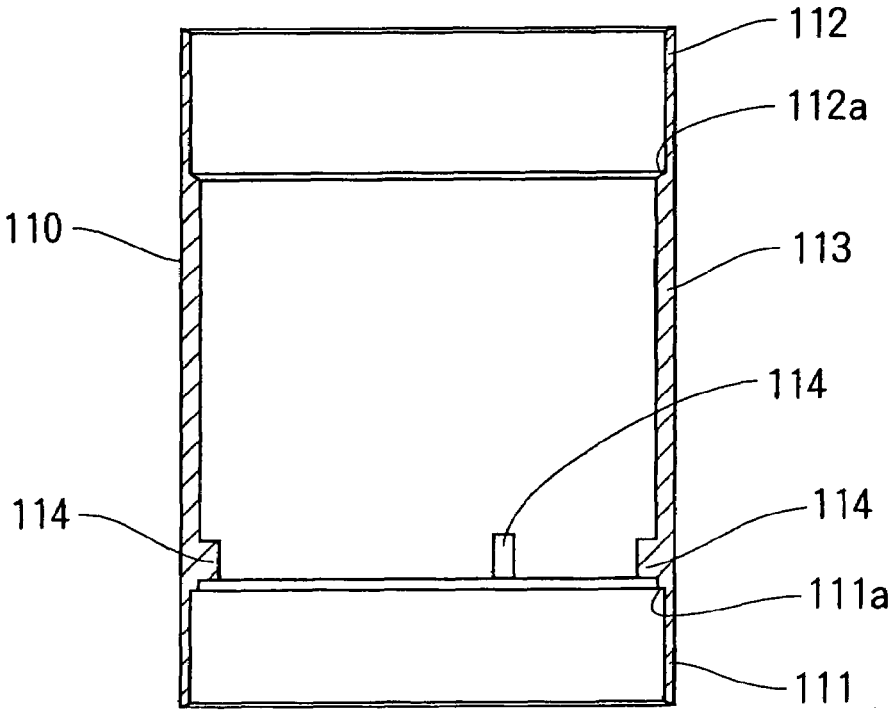
FIG. 5B is a partially cross-sectional side view showing the housing according to the second embodiment.

As shown in FIGS. 4 to 5B, a housing 110 has thin wall portions 111, 112 on both axial ends, and has a thick wall portion 113 that is axially inserted between the thin wall portions 111, 112. The thin wall portion 111 is crimped, so that the inlet cover 14 is secured to the thin wall portion 111. Inner steps 111*a*,112*a* are respectively formed at boundaries among the thin wall portions 111, 112 and the thick wall portion 113, in which thickness of housing 110 is stepwisely changed.

Three protrusions 114 are formed on the inner circumferential periphery of the housing 110. Protrusion is not formed on the outer circumferential periphery of the resinous impeller casing 120 in this embodiment.

The three protrusions 114 are circumferentially arranged at substantially regular angular intervals. Each protrusion 114 substantially radially protrudes to the outer circumferential periphery of the impeller casing 120 that radially oppose to the protrusion 114. The impeller casing 120 is press-inserted into the housing 110.

The impeller casing 120 has a substantially cylindrical shape, in which the outer diameter axially stepwisely changed. The outer diameter of the impeller casing 120 on the side of the armature 40 is smaller than the outer diameter of the impeller casing 120 on the axially opposite side as the armature 40. The outer circumferential periphery of the impeller casing 120 has an outer step 120*a*,in which the outer diameter is stepwisely changed.

The thin wall portion 111 of the housing 110 is radially crimped onto the inlet cover 14, so that the inner step 111*a* of the housing 110 circumferentially contacts with over an outer step 120*a* of the impeller casing 120 entirely in the axial direction. The housing 110 and the impeller casing 120 are circumferentially tightly sealed therebetween by crimping force. The three protrusions 114 formed on the inner circumferential periphery of the housing 110 are press-inserted to the outer circumferential periphery of the impeller casing 120, so that the center of the housing 110 and the center of the impeller casing 120 easily coincide with each other.

In the above embodiments, multiple protrusions respectively protrude to one of the inner circumferential periphery of the housing and the outer circumferential periphery of the impeller case that radially opposes to the protrusions. The protrusions are press-inserted into the one of the housing and the impeller case. In this structure, the entire outer circumferential periphery of the impeller case is not press-inserted into the inner circumferential periphery of the housing.

Therefore, radial force applied to the impeller case is reduced compared with the structure, in which the outer circumferential periphery of the impeller casing is entirely press-inserted into the inner circumferential periphery of the housing in a substantially axial direction of the housing. Thus, the impeller casing can be protected from deformation even when the impeller casing is made of resin, so that variation in clearance between the impeller casing and the impeller, which is received in the impeller casing, can be reduced. Therefore, the impeller casing and the impeller can be restricted from contacting with each other, so that a predetermined pumping capacity of the fuel pump 1 can be produced.

The impeller casing and the inlet cover are formed of resin, so that weight of the fuel pump can be reduced, and production cost of the fuel pump can be reduced.

Other Embodiment

At least one of the protrusions may be provided to at least one of the inner circumferential periphery of the housing and the outer circumferential periphery of the impeller case. The number of the protrusion may be an even number or an odd number. At least one of the protrusions may be respectively provided to both the inner circumferential periphery of the housing and the outer circumferential periphery of the impeller case. That is, the protrusion may be provided to both the housing and the impeller case. Each of the protrusions may be an individual member that is separate from the housing and the impeller casing, and the protrusion may be additionally provided to at least one of the housing and the impeller casing.

In the above embodiments, the inner step of the housing and the outer step of the impeller casing entirely contact over the circumferential direction to form a sealing structure. The protrusion is provided to one of the housing and the impeller casing on the side of the armature with respect to the sealing structure. Alternatively, the protrusion may be provided to at least one of the inner circumferential periphery of the housing and the outer circumferential periphery of the impeller casing on the opposite side of the armature with respect to the sealing structure. The protrusion may be press-inserted to the other of the housing and the impeller casing.

When the inner step of the housing and the outer step of the impeller casing entirely contact over the circumferential direction to form the sealing structure, the protrusion need not to be formed. That is, the protrusion need not to be provided to the inner circumferential periphery of the housing and the outer circumferential periphery of the impeller casing. When the protrusion is not provided to the housing and the impeller casing, a circumferential gap can be formed over the circumference between the inner circumferential periphery of the housing and the outer circumferential periphery of the impeller casing.

One of the impeller casing and the inlet cover may be formed of resin, and the other one of the impeller casing and the inlet cover may be formed of metal. Both of the impeller casing and the inlet cover may be formed of metal.

The above structures of the embodiments can be combined as appropriate.

Various modifications and alternations may be diversely made to the above embodiments without departing from the spirit of the present invention.

What is claimed is:

1. A fuel pump comprising:

a rotor;

a rotating member that is rotated by the rotor, the rotating member generating suction force for drawing fuel;

a pump portion that includes a pump casing receiving the rotating member; and a housing that receives the rotor and the pump portion, wherein the housing has an inner circumferential periphery, the pump casing has an outer circumferential periphery, the inner circumferential periphery of the housing contacts with the outer circumferential periphery of the pump casing in a substantially axial direction of the rotor to form a sealing portion in which the housing and the pump casing are substantially circumferential ly sealed therebetween, and the inner circumferential periphery of the housing and the outer circumferential periphery of the pump casing form a gap in a substantially radial direction of the housing on one of a side of the rotor and an opposite side as the rotor with respect to the sealing portions, the inner circumferential periphery of the housing and the outer circumferential periphery of the pump casing. which oppose to each other in a radial direction of the housing, form the gap therebetween, at least one of the inner circumferential periphery of the housing and the outer circumferential periphery of the rump casing has a plurality of protrusions that protrudes in a substantially radial direction of the housing, the plurality of protrusions is press-inserted into one of the inner circumferential periphery of the housing and the outer circumferential periphery of the pump casing, and the plurality of protrusions is arranged in a substantially circumferential direction of the housing.

2. The fuel pump according to claim 1, wherein the inner circumferential periphery of the housing has an inner step, in which an inner diameter of the inner circumferential periphery of the housing stepwisely changes, the outer circumferential periphery of the pump casing has an outer step, in which an outer diameter of the outer circumferential periphery of the pump casing stepwisely changes, and the inner step contacts with the outer step in the axial direction of the rotor to seal between the housing and the pump casing.

3. The fuel pump according to claim 1, wherein the housing is crimped onto the pump casing on an opposite side as the rotor, so that the housing is secured to the pump casing.

4. The fuel pump according to claim 1, wherein the plurality of protrusions includes at least three protrusions.

5. The fuel pump according to claim 1, wherein the plurality of protrusions are arranged at substantially regular intervals.

6. The fuel pump according to claim 1, wherein the pump casing is at least partially formed of resin.

7. A fuel pump comprising: a rotor; a rotating member that is rotated by the rotor, the rotating member generating suction force for drawing fuel; a pump portion that includes a pump casing receiving the rotating member; and a housing that receives the rotor and the pump portion, wherein the housing has an inner circumferential periphery, the pump casing has an outer circumferential periphery, at least one of the inner circumferential periphery of the housing and the outer circumferential periphery of the pump casing has a plurality of protrusions that protrudes in a substantially radial direction of the housing, the plurality of protrusions is arranged in a substantially circumferential direction of the housing, and the plurality of protrusions is press-inserted into at least one of the inner circumferential periphery of the housing and the outer circumferential periphery of the pump casing.

8. The fuel pump according to claim 7, wherein the plurality of protrusions includes at least three protrusions.

9. The fuel pump according to claim 7, wherein the plurality of protrusions is arranged at substantially regular intervals.

10. The fuel pump according to claim 7, wherein the pump casing is at least partially formed of resin.

11. The fuel pump according to claim 1, wherein at least one of the inner circumferential periphery of the housing and the outer circumferential periphery of the pump casing has a step, and the plurality of protrusions are located in the vicinity of the rotor with respect to the step.

12. The fuel pump according to claim 2, wherein the plurality of protrusions are located in the vicinity of the rotor with respect to both the inner step and the outer step.

13. The fuel pump according to claim 1, wherein adjacent two of the plurality of protrusions therebetween circumferentially define a gap.

* * * * *